US009355829B2

(12) United States Patent
Pyun et al.

(10) Patent No.: US 9,355,829 B2
(45) Date of Patent: May 31, 2016

(54) SAMPLE PLATE FOR MALDI-TOF MASS SPECTROMETER AND METHOD OF MANUFACTURING THE SAMPLE PLATE AND MASS SPECTROMETRY METHOD USING THE SAMPLE PLATE

(71) Applicant: Industry-Academic Cooperation Foundation, Yonsei University, Seoul (KR)

(72) Inventors: Jaechul Pyun, Seoul (KR); Jo Il Kim, Seoul (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 0 days.

(21) Appl. No.: 14/800,665

(22) Filed: Jul. 15, 2015

(65) Prior Publication Data

US 2016/0020080 A1 Jan. 21, 2016

(30) Foreign Application Priority Data

Jul. 16, 2014 (KR) ..... 10-2014-0089660

(51) Int. Cl.

| | |
|---|---|
| ***H01J 49/04*** | (2006.01) |
| ***B05D 1/00*** | (2006.01) |
| ***H01J 49/00*** | (2006.01) |
| ***H01J 49/16*** | (2006.01) |
| ***H01J 49/40*** | (2006.01) |

(52) U.S. Cl.

CPC ..... *H01J 49/0418* (2013.01); *B05D 1/60* (2013.01); *H01J 49/0031* (2013.01); *H01J 49/164* (2013.01); *H01J 49/40* (2013.01)

(58) Field of Classification Search

USPC ..... 250/288, 287

See application file for complete search history.

(56) References Cited

U.S. PATENT DOCUMENTS

| | | | | |
|---|---|---|---|---|
| 8,598,511 | B1 * | 12/2013 | Schlaf | H01J 49/0418 250/281 |
| 2005/0277201 | A1 * | 12/2005 | Sivarajan | G01N 33/6851 436/173 |
| 2013/0102084 | A1 * | 4/2013 | Loh | B01J 21/185 436/94 |

* cited by examiner

*Primary Examiner* — Kiet T Nguyen

(74) *Attorney, Agent, or Firm* — Lex IP Meister, PLLC

(57) ABSTRACT

The present invention relates to a sample plate to be used for a MALDI-TOF (Matrix Assisted Laser Desorption Ionization Time of Flight) mass spectrometer, and more particularly, to a sample plate for a MALDI-TOF mass spectrometer, which is particularly useful for molecular weight measurement of a high-volatile material, a method of manufacturing the sample plate and a mass spectrometry method using the sample plate. Object of the present invention to provide a method capable of performing a mass spectrometry for a high-volatile material by using a MALDI-TOF mass spectrometer so as to overcome the limits of the gas chromatography method of the related art. According to the present invention, there is provided a sample plate including a target plate, an organic matrix formed on one surface of the target plate, a parylene thin film formed on the target plate having the organic matrix formed thereon and formed to cover the entire organic matrix, and a sample fixing layer formed on the parylene thin film. The sample fixing layer is made of at least one material selected from a group consisting of graphene and carbon nano tube (CNT).

19 Claims, 7 Drawing Sheets

SAMPLE PLATE FOR MALDI-TOF MASS SPECTROMETER AND METHOD OF MANUFACTURING THE SAMPLE PLATE AND MASS SPECTROMETRY METHOD USING THE SAMPLE PLATE

CROSS REFERENCE TO RELATED APPLICATION

The present application claims priority from Korea Patent Application Number 2014-89660 filed on Jul. 16, 2014, the entire contents of which are incorporated herein for all purposes by this reference.

TECHNICAL FIELD

The present invention relates to a sample plate to be used for a MALDI-TOF (Matrix Assisted Laser Desorption Ionization Time of Flight) mass spectrometer, and more particularly, to a sample plate for a MALDI-TOF mass spectrometer, which is particularly useful for molecular weight measurement of a high-volatile material, a method of manufacturing the sample plate and a mass spectrometry method using the sample plate.

BACKGROUND ART

In general, a mass spectrometer is an analysis device configured to measure mass of a compound. The mass spectrometer is configured to electrically charge and ionize the compound, to measure mass and an electrical charge amount and to determine a molecular weight of the compound. As the method of ionizing the compound, an electron ionization method of using an electron beam, a method of colliding atoms at high speed, a method of using laser, and the like have been known.

The method of using laser is a method of mixing a matrix for assisting the ionization of the compound with a compound (sample) to be analyzed, arranging the mixture on a target of the analysis device, and illuminating the laser to the sample to ionize the sample with the aid of the matrix. The method has merits in that it is possible to measure a molecular weight of a high molecular material, to analyze a sample of a femtomole due to the high sensitivity and to remarkably reduce a phenomenon that the compound to be analyzed is split upon the ionization. Therefore, the MALDI-TOF mass spectrometry method using the laser is efficient in the mass spectrometry of the high molecular biochemical material such as protein and hexane. The MALDI-TOF mass spectrometer for the method is recently commercialized.

However, the typical matrix material has a molecular weight of hundreds of Da. When a molecular weight of the compound to be analyzed is similar to a molecular weight of the matrix material, a decomposed matter of the matrix appears on a mass spectrum. Therefore, the above method has a demerit in that it is difficult to use the same for the mass spectrometry of the compound having the molecular weight of hundreds of Da or less.

Also, for the MALDI-TOF mass spectrometry, a sample, which is an analysis target, is dropped on a sample plate, the sample plate is arranged at a predetermined position of the MALDI-TOF mass spectrometer and the laser is illuminated to ionize the sample. However, the high-volatile sample volatilizes and disappears from the sample plate before the laser is illuminated. Therefore, it is necessary to increase a concentration of the high-volatile sample. Also, it may not possible to perform the mass spectrometry, depending on the samples.

In the meantime, for the mass spectrometry of the high-volatile material of the chemical materials, a gas chromatography method is mainly used. The method is a method of using a principle that when a sample is arranged with a gas (carrier gas) such as helium and hydrogen being enabled to flow while keeping a flow rate thereof constant, the sample is heated and evaporated and the respective components are separated due to a difference of moving speeds while the sample passes through a long metallic pipe having active alumina or silica gel filled therein. However, the gas chromatography method has demerits in that the steps for analyzing each sample are more complicated, the cost for one analysis is increased and the correctness is lowered, as compared to the MALDI-TOF mass spectrometry.

SUMMARY OF THE INVENTION

It is therefore an object of the present invention to provide a method capable of performing a mass spectrometry for a high-volatile material by using a MALDI-TOF mass spectrometer so as to overcome the limits of the gas chromatography method of the related art.

Another object of the present invention is to provide a sample plate for a MALDI-TOF mass spectrometer capable of performing a mass spectrometry for a high-volatile material.

According to the present invention, there is provided a sample plate including a target plate, an organic matrix formed on one surface of the target plate, a parylene thin film formed on the target plate having the organic matrix formed thereon and formed to cover the entire organic matrix, and a sample fixing layer formed on the parylene thin film. The sample fixing layer is made of at least one material selected from a group consisting of graphene and carbon nano tube (CNT).

In an illustrative embodiment, the sample fixing layer is preferably made of graphene.

In an illustrative embodiment, at least one material selected from the group consisting of graphene and carbon nano tube may be mixed with a sample, which is an analysis target, and a mixture thereof may be formed on the parylene thin film, as the sample fixing layer.

In an illustrative embodiment, the sample fixing layer may be formed on the parylene thin film without being mixed with a sample, which is an analysis target.

In an illustrative embodiment, the sample plate may further include an analysis target formed on the parylene thin film.

In an illustrative embodiment, the parylene thin film is preferably formed to have a thickness of 10 nm to 100 nm.

In an illustrative embodiment, the parylene thin film is preferably parylene-N thin film.

In an illustrative embodiment, the sample plate is a sample plate for a MALDI-TOF (Matrix Assisted Laser Desorption Ionization Time of Flight) mass spectrometer.

In an illustrative embodiment, the sample fixing layer is preferably made of graphene.

According to another aspect of the present invention, there is provided a method of manufacturing a sample plate. The method includes steps of forming an organic matrix on one surface of a target plate, forming a parylene thin film on the target plate having the organic matrix formed thereon so that it covers the entire organic matrix, and forming a sample fixing layer by using at least one material selected from a group consisting of graphene and carbon nano tube (CNT).

In an illustrative embodiment, the step of forming the sample fixing layer may include steps of mixing at least one material selected from the group consisting of graphene and carbon nano tube with a sample, which is an analysis target, and forming a sample fixing layer mixed with the sample on the parylene thin film.

In an illustrative embodiment, in the step of forming the sample fixing layer, the sample fixing layer may be formed on the parylene thin film without being mixed with a sample, which is an analysis target.

In an illustrative embodiment, the method may further include a step of forming the sample on the sample fixing layer.

In an illustrative embodiment, the parylene thin film is preferably parylene-N thin film.

In an illustrative embodiment, the step of forming the parylene thin film may include a first step of evaporating parylene dimer, a second step of thermally decomposing the evaporated parylene dimer to form an intermediate product, and a third step of introducing the intermediate product into a vapor deposition chamber and forming the parylene thin film on the target plate having the organic matrix formed thereon.

In an illustrative embodiment, the sample plate is preferably a sample plate for a MALDI-TOF mass spectrometer.

According to another aspect of the present invention, there is provided a mass spectrometry method using a MALDI-TOF (Matrix Assisted Laser Desorption Ionization Time of Flight) mass spectrometer. The method includes steps of providing a sample plate including a target plate, an organic matrix formed on one surface of the target plate, a parylene thin film formed on the target plate having the organic matrix formed thereon and formed to cover the entire organic matrix, and a sample fixing layer formed on the parylene thin film, the sample fixing layer being made of at least one material selected from a group consisting of graphene and carbon nano tube (CNT); forming a sample, which is an analysis target, on the sample fixing layer; positioning the sample plate having the sample mounted thereon at a predetermined position of the MALDI-TOF mass spectrometer; illuminating laser to the sample plate to desorb and ionize the sample, and performing mass spectrometry for the ionized sample.

According to another aspect of the present invention, there is provided a mass spectrometry method using a MALDI-TOF (Matrix Assisted Laser Desorption Ionization Time of Flight) mass spectrometer. The method includes steps of providing a sample plate including a target plate, an organic matrix formed on one surface of the target plate, and a parylene thin film formed on the target plate having the organic matrix formed thereon and formed to cover the entire organic matrix; mixing a sample, which is an analysis target, with at least one material selected from a group consisting of graphene and carbon nano tube (CNT); forming the sample on the sample plate; positioning the sample plate having the sample mounted thereon at a predetermined position of the MALDI-TOF mass spectrometer; illuminating layer to the sample plate to desorb and ionize the sample, and performing mass spectrometry for the ionized sample.

In an illustrative embodiment, the material mixed with the sample fixing layer or sample is preferably graphene.

When the sample plate of the present invention is used, even though the analysis target is a high-volatile material, the graphene or CNT formed on the sample plate and positioned below the sample or directly mixed with the sample prevents the analysis target from being evaporated into the air. Therefore, it is possible to perform the mass spectrometry even for the high-volatile material by using the MALDI-TOF mass spectrometer.

Also, according to the sample plate of the present invention, the parylene thin film is formed on the organic matrix. Therefore, even when the laser is illuminated, the organic matrix is ionized but does not reach a detector, so that it does not disturb the correct mass spectrometry. Therefore, the sample plate is particularly suitable for the mass spectrometry of the high-volatile material.

DETAILED DESCRIPTION OF ILLUSTRATIVE EMBODIMENTS

Hereinafter, a sample plate for a MALDI-TOF mass spectrometer, a method of manufacturing the same, and a mass spectrometry method using the same plate in accordance with a preferred illustrative embodiment of the present invention will be described in detail with reference to the accompanying drawings.

Figure 1:
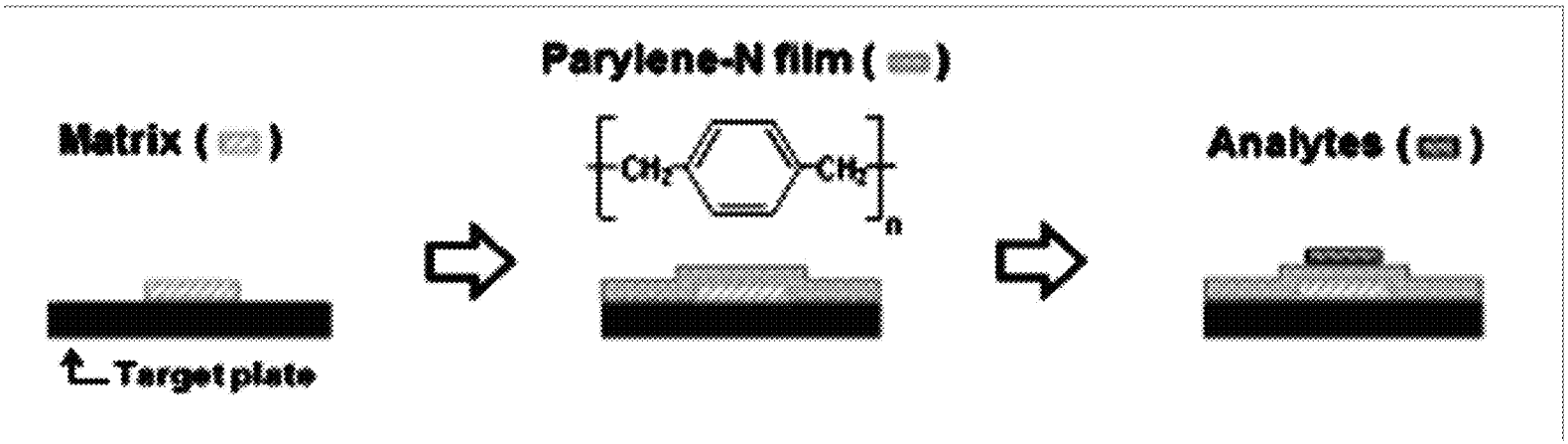
FIG. 1 is a schematic view illustrating a process of forming a sample plate according to a preferred illustrative embodiment of the present invention.

FIG. 1 is a schematic view illustrating a process of forming a sample plate according to a preferred illustrative embodiment of the present invention.

According to a first illustrative embodiment, a target plate for a MALDI-TOF mass spectrometer is prepared. The target plate is made of metal, for example, stainless steel. However, the present invention is not limited thereto.

Next, an organic matrix solution is dropped on the target plate and a solvent is dried to form an organic matrix. In a test according to a preferred illustrative embodiment of the present invention, in order to form α-Cyano-4-hydroxycinnamic acid (CHCA) organic matrix, as the organic matrix solution, a solution in which α-Cyano-4-hydroxycinnamic acid (CHCA) was dissolved at a concentration of 10 mg/ml in acetonitrile/water (1:1, v/v) having 0.1% trifluoroacetic acid added thereto was used. However, the organic matrix solution may be diversely selected depending on a type of a compound to be analyzed, and the present invention is not limited to the solution.

Next, a parylene thin film is deposited on the target plate having the organic matrix formed thereon. In general, parylene is a polymer in which p-xylene is polymerized, and is clear and has waterproof, flameproof and corrosion resistance properties, so that it can be applied to a variety of fields. Also, parylene to be deposited on a substrate generally means p-xylene dimer and is commonly referred to as parylene-N.

Figure 2:
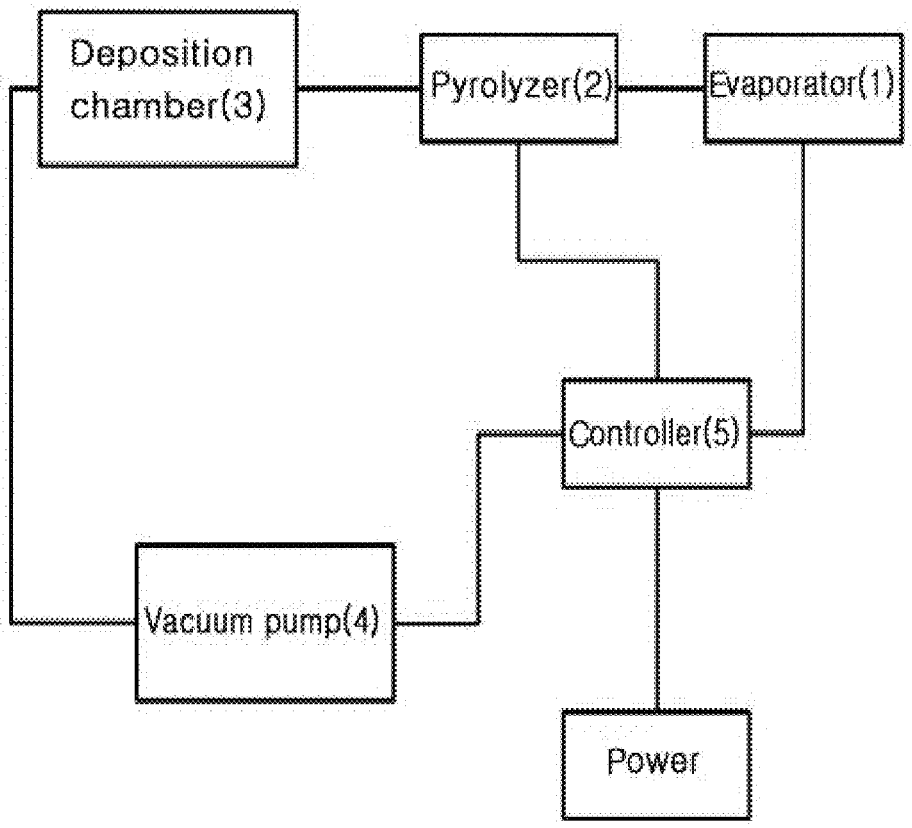
FIG. 2 is a block diagram showing an example of a parylene thin film forming apparatus.

FIG. 2 is a block diagram showing an example of a parylene thin film forming apparatus. As shown in FIG. 2, the parylene thin film forming apparatus of the related art includes an evaporation unit 1 configured to heat parylene dimer powder and to evaporate parylene, a thermal decomposition unit 2 configured to thermally decompose the evaporated parylene dimer gas at high temperatures and to form a high-reactive p-xylen radical, which is an intermediate product, a vapor deposition chamber 3 configured to introduce therein the high-reactive p-xylene radical and to deposit the high-reactive p-xylene radical on a substrate under vacuum state, a vacuum pump 4 configured to suck parylene monomer gas from the vapor deposition chamber 3 and to enable a trapping through a cold trap, and a control unit 5 configured to control various functions and operations of the apparatus. Although not shown in FIG. 2, the apparatus further includes connection pipes configured to connect the evaporation unit 1, the thermal decomposition unit 2, the vapor deposition chamber 3 and the vacuum pump 4, and a variety of valves configured to adjust the evaporation unit 1, the thermal decomposition unit 2, the vapor deposition chamber 3 and the vacuum pump 4.

According to a preferred illustrative embodiment of the present invention, a parylene thin film forming method includes a first step of evaporating parylene dimer, a second step of thermally decomposing the evaporated parylene dimer to form an intermediate product, and a third step of introducing the intermediate product into a vapor deposition chamber and forming a parylene thin film on a substrate arranged in the vapor deposition chamber.

Specifically, the parylene dimer to be evaporated in the first step is preferably parylene dimer powder for effective evaporation. In this case, the parylene dimer powder is preferably evaporated at temperatures of 100° C. or higher, preferably 140° C. to 180° C. so that the parylene dimer powder is directly evaporated without being liquefied.

Also, in the second step, the parylene dimer gas is thermally decomposed at temperatures of 600° C. or higher, preferably 650° C. or higher. By the thermal decomposition, the intermediate product is generated. When parylene-N is thermally decomposed, the high-reactive p-xylene radical is generated as the intermediate product.

Also, in the third step, the thermally decomposed intermediate product is introduced into the vapor deposition chamber, is deposited to form the parylene thin film on the substrate arranged in the vapor deposition chamber. The formation of the parylene thin film is preferably performed at vacuum and room temperature conditions.

In the meantime, according to a preferred illustrative embodiment of the present invention, the substrate arranged in the vapor deposition chamber is a target plate having an organic matrix formed thereon.

The deposition of the parylene thin film has a merit in that a uniform deposition can be made irrespective of substrate shapes because the deposition is performed in the gas phase. Also, parylene can be made into a thin film having a thickness of dozens of nanometers or less because the thin film growth is slow, and the parylene thin film has a uniform and tight surface and excellent waterproof and electrical insulation properties.

In the meantime, it should be noted that one skilled in the art can form the parylene thin film by a variety of methods, in addition to the above method, and the present invention is not limited to the method of the illustrative embodiment.

Next, graphene or carbon nano tube (CNT) is mixed with a sample, which is an analysis target. That is, the sample in FIG. 1 is a mixture of the sample and graphene or CNT. According to a preferred illustrative embodiment of the present invention, the sample, which is an analysis target, is mixed with graphene 500 ng/spot or CNT 5 μg/spot at various concentrations.

Then, the sample mixed with graphene or CNT is dropped on the parylene thin film on the sample plate, which is then dried and crystallized. Thereby, the sample plate is subject to a state suitable for mass spectrometry. According to a preferred illustrative embodiment of the present invention, the sample mixed with graphene or CNT is put into each spot in an amount of 1 μl/spot.

Figure 3:
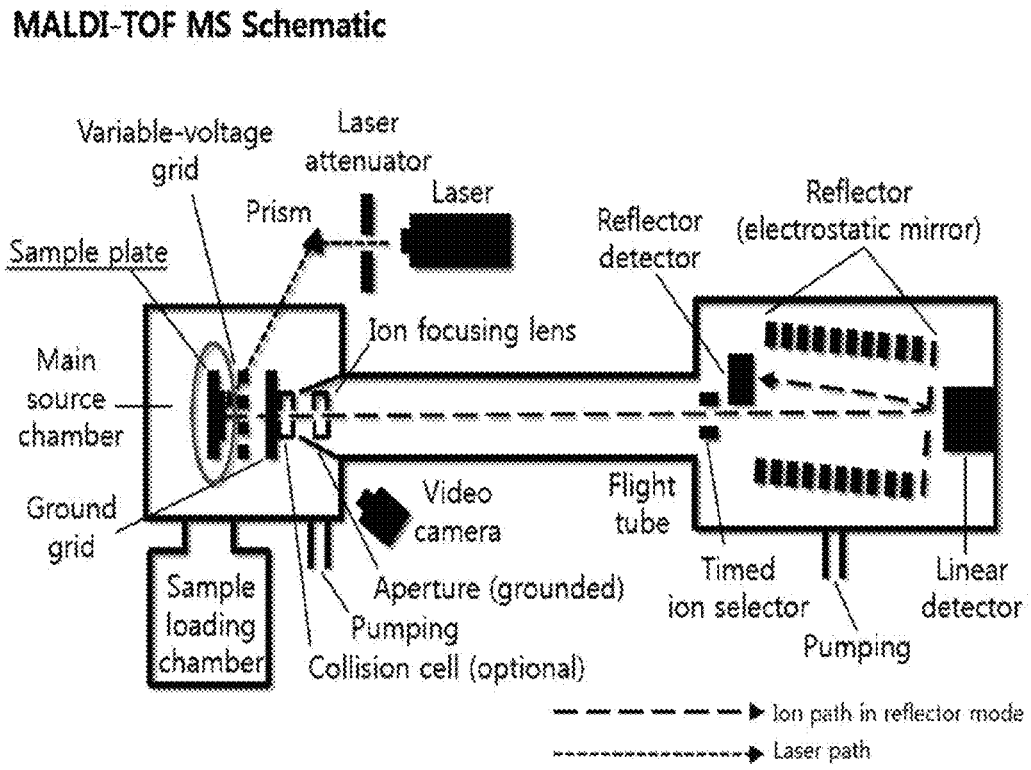
FIG. 3 illustrates an example of a structure of a MALDI-TOF mass spectrometer, which is used in an illustrative embodiment.

A method of performing the mass spectrometry for a predetermined sample by using the sample plate according to a preferred illustrative embodiment. FIG. 3 illustrates an example of a structure of a MALDI-TOF mass spectrometer, which is used in the illustrative embodiment. First, the sample plate is arranged at a designated position (a position denoted with 'Sample plate') in a mass spectrometer main chamber shown in FIG. 3 and then the laser is illuminated from a laser generation apparatus. The laser illuminated to a surface of the sample plate ionizes a part of a compound, which is an analysis target, and the ionized sample is accelerated by an electric field and passes through a flight tube. The ionized sample having passed through the flight tube collides with a detector, and the mass spectrometer calculates time consumed until the ionized sample collides with the detector from the surface of the sample plate, thereby perceiving the mass of the compound configuring the sample.

In the meantime, according to another illustrative embodiment of the present invention, graphene or CNT may be sequentially applied to the sample plate, instead of being mixed with the sample. That is, after sequentially forming the organic matrix and the parylene thin film on the sample plate, a thin film layer of graphene or CNT is formed as a sample fixing layer. At this time, a thickness of the thin film layer may be several nanometers to dozens of nanometers, and is not particularly limited. Then, a high-volatile sample is dropped on the sample fixing layer, and the sample is dried and crystallized. Since a process of forming the organic matrix and the parylene thin film and a process of applying the sample plate to the MALDI-TOF mass spectrometer to perform the mass spectrometry according to the another illustrative embodiment is substantially the same as the preferred illustrative embodiment of the present invention, the descriptions thereof are omitted.

Figure 4:
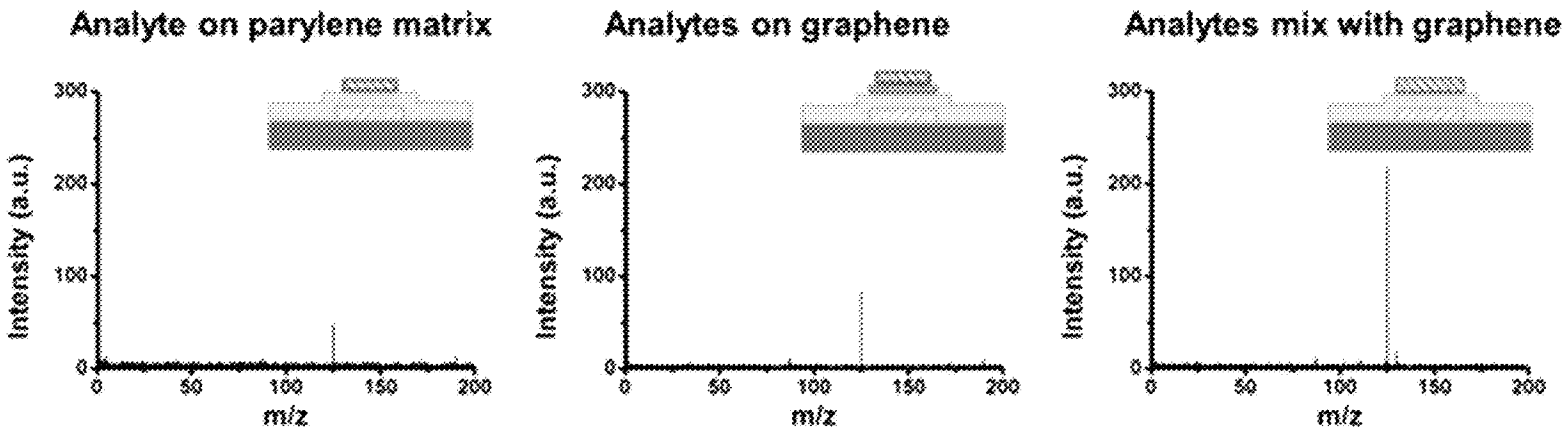
FIG. 4 illustrates cases where dimethyl methyl phosphonate (DMMP) is formed on the parylene thin film, where DMMP is formed on the organic matrix, the parylene thin film and the fixing layer of the graphene on the target plate, and where a mixture of DMMP and graphene is formed on the parylene thin film.

FIG. 4 illustrates a case where after forming the organic matrix and the parylene thin film on the target plate, dimethyl methyl phosphonate (DMMP), which is a sample, is formed on the parylene thin film without forming the sample fixing layer of graphene or CNT, a case where after forming the organic matrix, the parylene thin film and the fixing layer of graphene on the target plate, DMMP is formed on the fixing layer, and a case where after forming the organic matrix and the parylene thin film on the target plate, a mixture of DMMP and graphene is formed on the parylene thin film. DMMP used in FIG. 4 is a material referred to as sarin gas, and high-concentration DMMP having a molecular weight of 124.08 Da, which was not diluted, was used.

As shown in FIG. 4, when using DMMP without mixing with graphene or CNT, DMMP was little detected even by the MALDI-TOF mass spectrometer. However, when the graphene fixing layer is formed below DMMP, it is possible to detect DMMP at a considerable level. That is, when DMMP and graphene are mixed, DMMP can be detected well.

Figure 5:
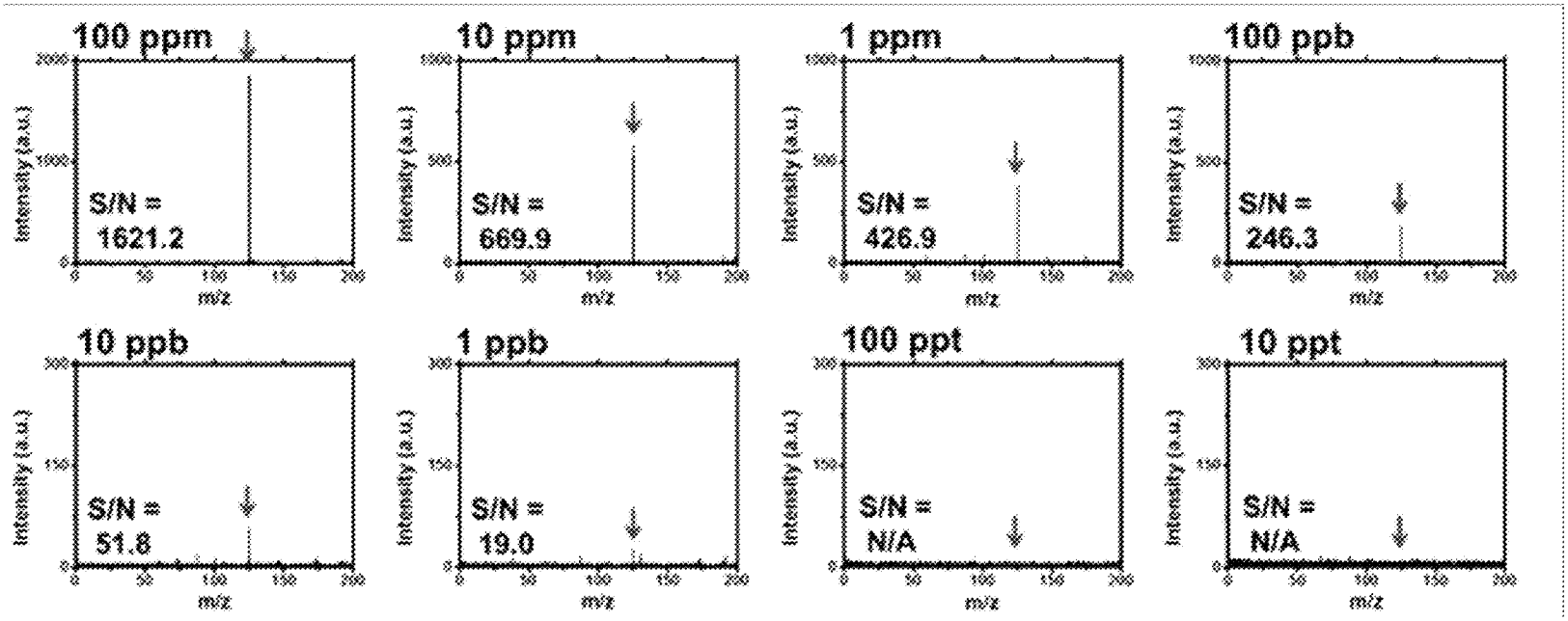
FIG. 5 shows results of molecular weight measurement after making sample plates by a variety of methods.

FIG. 5 shows results of mass spectrometry at each concentration when mixtures of DMMP of various concentrations and graphene are formed on the parylene thin film on the sample plate having the organic matrix and parylene thin film formed thereon. As shown in FIG. 5, even when the concentration of the sample is low such as 1 to 10 ppb, it can be seen that there are peaks at molecular weight positions of DMMP.

Figure 6:
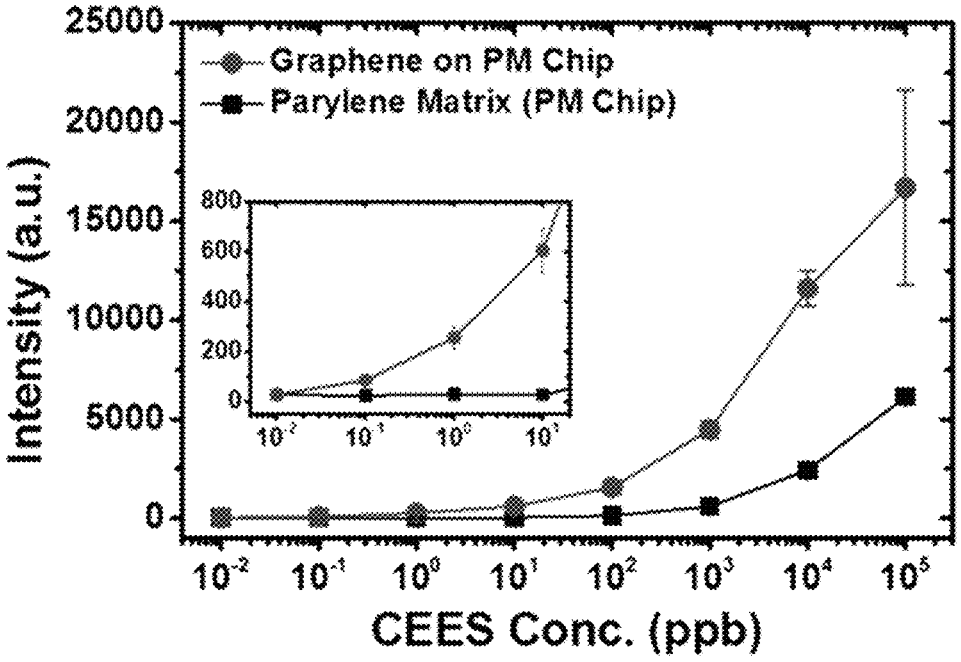
FIG. 6 shows results of molecular weight measurement of compounds having diverse molecular weights by using the sample plate of the preferred illustrative embodiment.

FIG. 6 shows results of mass spectrometry at each concentration when mixtures of CEED (2-chloroethylethysulfide) of various concentrations and graphene are formed on the parylene thin film on the sample plate having the organic matrix and parylene thin film formed thereon. As shown in FIG. 6, when CEED is mixed with graphene, CEED is better detected, as compared to a case where CEED is not mixed with graphene.

Figure 7:
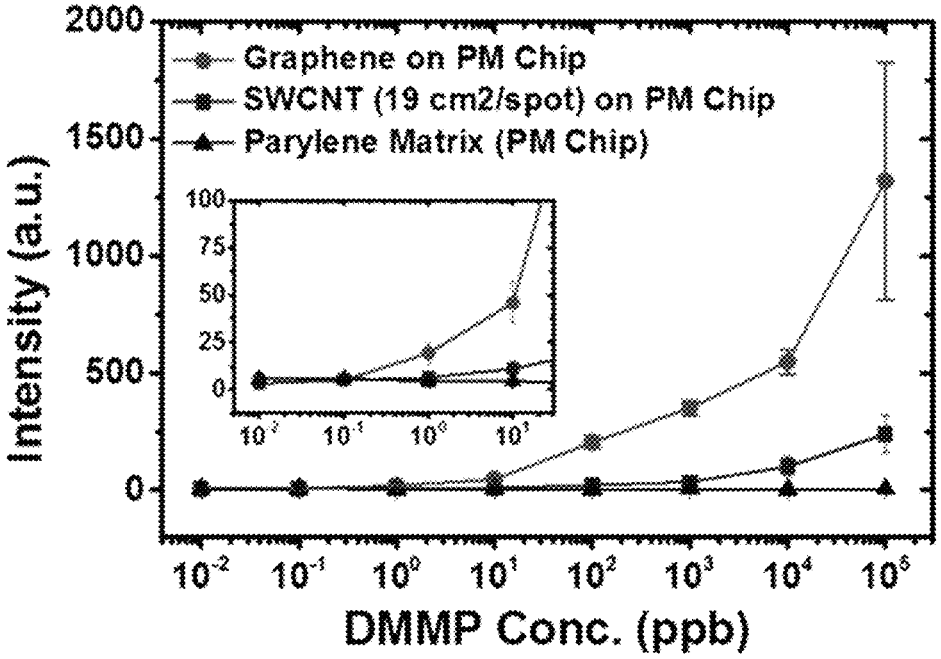
FIG. 7 shows results of mass spectrometry at each concentration when mixtures of DMMP of various concentrations and graphene or CNT are formed on the parylene thin film on the sample plate having the organic matrix and parylene thin film formed thereon.

Also, FIG. 7 shows results of mass spectrometry at each concentration when mixtures of DMMP of various concentrations and graphene or CNT are formed on the parylene thin film on the sample plate having the organic matrix and parylene thin film formed thereon. As shown in FIG. 7, when DMMP is not mixed with graphene or CNT, DMMP is little detected irrespective of the concentrations of DMMP. However, when DMMP is mixed with graphene, DMMP of 1 to 10 ppb is detected. Also, when DMMP is mixed with CNT, DMMP of 10 to 100 ppb is detected.

As described above, when using the sample plate of the related art in which the organic matrix and the compound, which is an analysis target, are mixed and formed on the sample plate, the organic matrix assists the ionization of the compound. Therefore, when the laser is illuminated, the compound is easily ionized, so that it is possible to increase an amount of the compound ions to collide with the detector and to analyze the mass of the compound. However, in this case, when the laser is illuminated, the organic matrix is also ionized, so that the ions thereof collide with the detector and are detected by the detector. Therefore, when the molecular weights of the compound to be analyzed and the organic matrix are similar to each other, it is not possible to correctly perceive the analysis target. Also, in case of a high-volatile material, when the sample is dropped on the sample plate, the sample volatilizes before the laser is illuminated. Therefore, it is not possible to ionize the sample.

However, when the laser is illuminated to the sample plate according to the preferred illustrative embodiment of the present invention, the compound, which is an analysis target, is ionized at a similar level to the case where the organic matrix and the compound are mixed. However, the organic matrix does not reach the detector through the parylene thin film and the ions colliding with the detector are the ions of the analysis target. Therefore, it is possible to correctly perceive a type of the compound, which is an analysis target. Also, since the graphene or CNT prevents the sample from being evaporated into the air, it is possible to perform the mass spectrometry even for the high-volatile sample by using the MALDI-TOF mass spectrometer.

Although the sample plate for a MALDI-TOF mass spectrometer, the method of manufacturing the sample plate and the mass spectrometry method using the sample plate according to the preferred illustrative embodiment of the present invention have been described with reference to the various examples, it should be noted that the illustrative embodiment can be variously changed and modified by one skilled in the art. Therefore, the scope of the present invention is limited only by the claims to be described below.

What is claim is:

1. A sample plate including:

a target plate, an organic matrix formed on one surface of the target plate, a parylene thin film formed on the target plate having the organic matrix formed thereon and formed to cover the entire organic matrix, and a sample fixing layer formed on the parylene thin film, wherein the sample fixing layer is made of at least one material selected from a group consisting of graphene and carbon nano tube (CNT).

2. The sample plate of claim 1, wherein the sample fixing layer is preferably made of graphene.

3. The sample plate of claim 1, at least one material selected from the group consisting of graphene and carbon nano tube (CNT) may be mixed with a sample, which is an analysis target, and a mixture thereof may be formed on the parylene thin film, as the sample fixing layer.

4. The sample plate of claim 1, the sample fixing layer may be formed on the parylene thin film without being mixed with a sample, which is an analysis target.

5. The sample plate of claim 4, the sample plate may further include an analysis target formed on the parylene thin film.

6. The sample plate of claim 1, the parylene thin film is formed to have a thickness of 10 nm to 100 nm.

7. The sample plate of claim 1, the parylene thin film is a parylene-N thin film.

8. The sample plate of claim 1, the sample plate is a sample plate for a MALDI-TOF (Matrix Assisted Laser Desorption Ionization Time of Flight) mass spectrometer.

9. A method of manufacturing a sample plate, the method including the steps of:

forming an organic matrix on one surface of a target plate, forming a parylene thin film on the target plate having the organic matrix formed thereon so that it covers the entire organic matrix, and forming a sample fixing layer by using at least one material selected from a group consisting of graphene and carbon nano tube (CNT).

10. The method of claim 9, the step of forming the sample fixing layer may include steps of mixing at least one material selected from the group consisting of graphene and carbon nano tube with a sample, which is an analysis target, and forming a sample fixing layer mixed with the sample on the parylene thin film.

11. The method of claim 10, the step of forming the sample fixing layer, the sample fixing layer may be formed on the parylene thin film without being mixed with a sample, which is an analysis target.

12. The method of claim 11, the method may further include a step of forming the sample on the sample fixing layer.

13. The method of claim 10, the parylene thin film is preferably parylene-N thin film.

14. The method of claim 10, the step of forming the parylene thin film may include a first step of evaporating parylene dimer, a second step of thermally decomposing the evaporated parylene dimer to form an intermediate product, and a third step of introducing the intermediate product into a vapor deposition chamber and forming the parylene thin film on the target plate having the organic matrix formed thereon.

15. The method of claim 10, the sample plate is preferably a sample plate for a MALDI-TOF mass spectrometer.

16. A mass spectrometry method using a MALDI-TOF (Matrix Assisted Laser Desorption Ionization Time of Flight) mass spectrometer, the method including the steps of:

providing a sample plate including a target plate, an organic matrix formed on one surface of the target plate, a parylene thin film formed on the target plate having the organic matrix formed thereon and formed to cover the entire organic matrix, and a sample fixing layer formed on the parylene thin film, the sample fixing layer being made of at least one material selected from a group consisting of graphene and carbon nano tube (CNT);

forming a sample, which is an analysis target, on the sample fixing layer;

positioning the sample plate having the sample mounted thereon at a predetermined position of the MALDI-TOF mass spectrometer;

illuminating laser to the sample plate to desorb and ionize the sample, and performing mass spectrometry for the ionized sample.

17. The method of claim 16, the material mixed with the sample fixing layer or sample is preferably graphene.

18. A mass spectrometry method using a MALDI-TOF (Matrix Assisted Laser Desorption Ionization Time of Flight) mass spectrometer, the method including the steps of:

providing a sample plate including a target plate, an organic matrix formed on one surface of the target plate, and a parylene thin film formed on the target plate having the organic matrix formed thereon and formed to cover the entire organic matrix; mixing a sample, which is an analysis target, with at least one material selected from a group consisting of graphene and carbon nano tube (CNT);

forming the sample on the sample plate;

positioning the sample plate having the sample mounted thereon at a predetermined position of the MALDI-TOF mass spectrometer;

illuminating laser to the sample plate to desorb and ionize the sample, and performing mass spectrometry for the ionized sample.

19. The method of claim 18, the material mixed with a sample fixing layer or sample is preferably graphene.

* * * * *